United States Patent [19]

Oshima

[11] 3,953,022

[45] Apr. 27, 1976

[54] SHEET COUNTER

[75] Inventor: Takeo Oshima, Himeji, Japan

[73] Assignee: Glory Kogyo Kabushiki Kaisha, Japan

[22] Filed: Jan. 27, 1975

[21] Appl. No.: 544,583

Related U.S. Application Data

[63] Continuation of Ser. No. 328,076, Jan. 30, 1973, abandoned.

[30] Foreign Application Priority Data

Jan. 31, 1972 Japan ..... 47-11215

[52] U.S. Cl. ..... 271/95; 271/110; 271/127; 235/98 R

[51] Int. Cl.[2] ..... B65H 3/10

[58] Field of Search ..... 271/95, 100, 105, 106, 271/117, 126, 127, 149, 157, 110, 111; 235/98 R

[56] References Cited

UNITED STATES PATENTS 2,912,242 11/1959 Richardson ..... 271/95

3,643,939 2/1972 Nussbaum et al. ..... 271/110

3,652,081 3/1972 Hatanaka et al. ..... 271/95

*Primary Examiner*—Evon C. Blunk

*Assistant Examiner*—Robert Saifer

*Attorney, Agent, or Firm*—Holman & Stern

[57] ABSTRACT

In a sheet counter in which sheets held in a stack in sheet-holding means are successively separated from the stack by suction heads, there are provided first electrical switch means such as a microswitch which is closed when the sheet-holding means has been manually moved to a sheet-loading position and second switch means which is closed when the stack of sheets loaded on the sheet-holding means has been carried to a counting position. An electric motor for imparting rotation to the suction heads and a vacuum pump for creating a partial vacuum therein are set in operation only when both of the first and second switch means have been thus closed. The sheet counter is also provided with means for properly readjusting the position of the suction heads relative to the stack of sheets prior to counting operation.

5 Claims, 3 Drawing Figures

SHEET COUNTER

This is a continuation of application Ser. No. 328,076 filed Jan. 30, 1973, now abandoned.

BACKGROUND OF THE INVENTION

This invention relates to improvements in counters for counting the number of bank notes, cards, tickets and other sheets of paper or like material having a definite size (hereinafter referred to simply as "sheets").

A typical example of known sheet counters includes an electric motor for rotating a disk-like mount on which usually a plurality of suctions heads are rotatably mounted, and a vacuum pump for creating a required degree of vacuum in the suction heads. Sheets held in a neat stack by sheet-holding means within the counter are successively separated into another stack by the suction heads which rotate about their own axes while revolving around the axis of the disk-like mount.

Heretofore, before starting the counting operation with this type of sheet counter, the operator has had to visually confirm that the stack of sheets placed upon the sheet-holding means in a loading position has been properly carried to a counting position opposite the suction heads. Thus, in order to count a large number of sheets, the starting button has had to be operated for each new stack of the sheets loaded on the counter. Another drawback of the prior art sheet counters resides in the fact that there have been no truly simplified means for the readjustment of the position of the suction heads relative to the stack of sheets prior to their counting operation.

SUMMARY OF THE INVENTION

In view of the listed disadvantages of the prior art, it is an object of the present invention to provide an improved sheet counter in which the counting operation is started automatically as a stack of sheets placed on sheet-holding means in a loading position is carried to a counting position.

Another object of the invention is to provide a sheet counter in which the stack of sheets placed on the sheet-holding means is utilized to start a counting operation, without need for any complex mechanical or electrical means, in such a manner that the operation of the counter is automatically stopped when all the sheets of the stack have been counted.

A further object of the invention is to provide a sheet counter in which at least one electrical switch is operated, for automatic starting of the counting operation, so that there is practically no possibility of the sheets being damaged by accidental operation of a suction head or heads.

A further object of the invention is to provide a sheet counter in which, as a stack of sheets to be counted is placed on the sheet-holding means in the loading position, the suction head or heads are automatically readjusted to a proper standby position, so that the succeeding counting operation can be started efficiently without any possibility of damaging or miscounting the sheets.

With these objects in view and the other objects hereinafter set forth, the present invention provides, in a sheet counter of the type described, the improvement comprising sheet counting means including at least one suction head, drive means adapted to impart a driving force to said sheet counting means, a vacuum pump for creating a pre-determined vacuum for said suction head in order to successively separate sheets held by sheet-holding means, and electrical circuit means adapted to cause operations of said drive means and said vacuum pump; characterized by comprising transferring means adapted to transfer said sheet-holding means between a sheet loading position and a sheet counting position of said sheet counting means, and switch means connected to said electrical circuit means so as to be operated when a stack of sheets loaded onto said sheet-holding means has been moved from said loading position to said counting position, whereby said drive means and vacuum pump are made to be operated when switch means has been operated.

The features which are believed to be novel and characteristic of this invention are set forth with particularity in the appended claims. The invention itself, however, both as to its construction and mode of operation, together with the additional objects and advantages thereof, will be best understood from the following description of a preferred embodiment taken in conjunction with the accompanying drawings in which like reference characters designate like parts throughout the several views.

DETAILED DESCRIPTION

Figure 1:
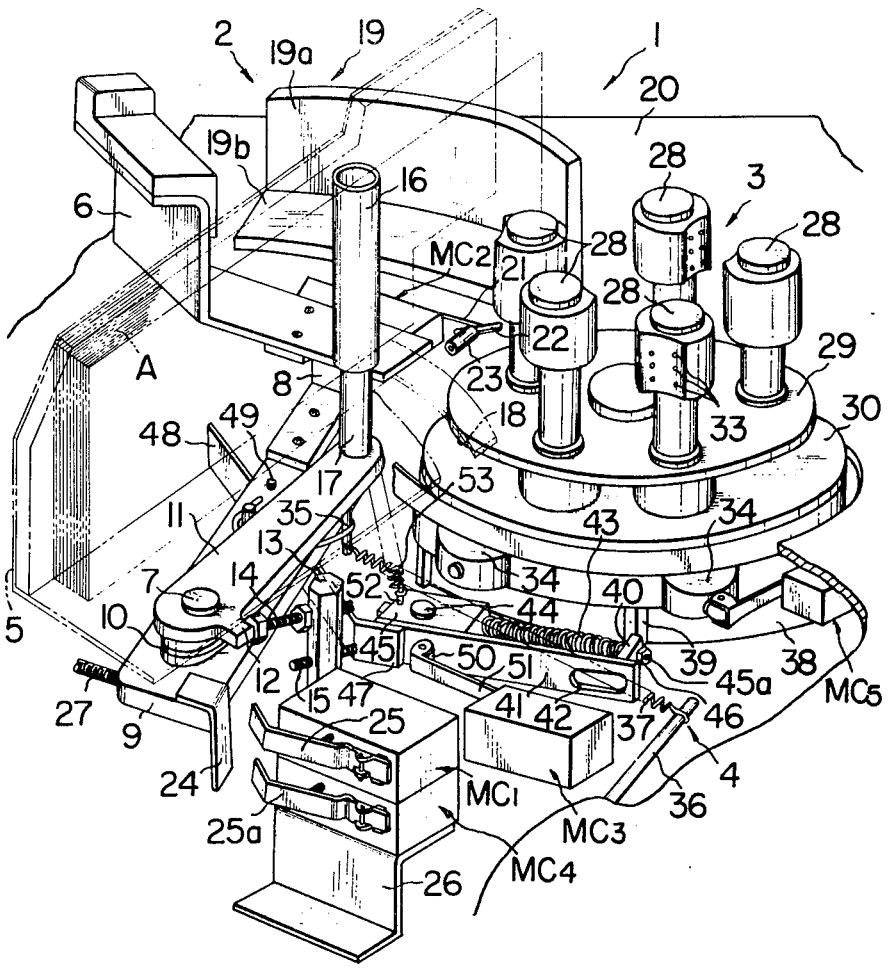
FIG. 1 is a perspective view showing the essential parts of an example of a sheet counter according to the invention.

With particular reference to FIG. 1 of the drawings, the example sheet counter generally designated by the numeral 1 is broadly comprised of sheet-holding means 2 for holding a stack of sheets A such for example as bills, counting means 3 for counting the number of the sheets A held in a stack by the sheet-holding means 2, and locking means 4 for locking the motion of the counting means 3 as required.

The sheet-holding means 2 includes a support 5 of well known construction on which is to be placed the stack of sheets A. Below the support 5 there is provided a substantially L-shaped lever 6 in face-to-face relationship therewith, the L-shaped lever 6 being horizontally swingably supported by a pin 7 through a substantially U-shaped member 8 and a planar arm 9. A spring member 10 is supported by the pin 7 to resiliently hold the planar arm 9 and an elongate plate 11 thereabove in positions relative to each other, the elongate plate 11 being also pivotally supported by the pin 7 at one end thereof. At the same end of the elongate plate 11, a lateral projection 12 is formed which is held in abutment with one end of an adjusting bolt 14, the other end of which is affixed to a stationary post 13, so that the elongate plate 11 is prevented from turning counterclockwise, as viewed in FIG. 1, around the pin 7. Another adjusting bolt 15 is provided below the first mentioned adjusting bolt 14 in order to regulate the angle of swing of the planar arm 9 in case the same has turned against the spring member 10.

On the other end of the elongate plate 11, there is vertically mounted a post 17 tightly wrapped with a cylindrical member 16 made preferably of rubber or like material. Thus, the sheets A are held in a neat stack between this post 17 and the vertical wall portion of the support 5 during counting operation. It is to be noted that the bottom portion of the support 5 is slotted at 18 to permit the post 17, extending upwardly therethrough, to be turned horizontally around the pin 7 with the elongate plate 11.

The sheet-holding means 2 further includes a guide 19 for holding the stack of sheets A in a neatly registered condition by contacting one edge thereof. The guide 19 is comprised of a vertical portion 19*a* securely supported by a stationary part 20 of the sheet counter 1 and a horizontal portion 19*b*. Between this guide 19 and the aforesaid mount 5 there is provided an electrical switch $MC_2$, such as a microswitch, which is to be closed when the stack of sheets A has been moved through its intermediate position II, FIG. 2, from the loading position I to the counting position. The switch $MC_2$ has a lever 21 for engagement with an actuating member 22 which is pivotally supported by a bracket 23. The switch $MC_2$ and the bracket 23 are both supported by a stationary part of the sheet counter not shown in the drawings.

Figure 2:
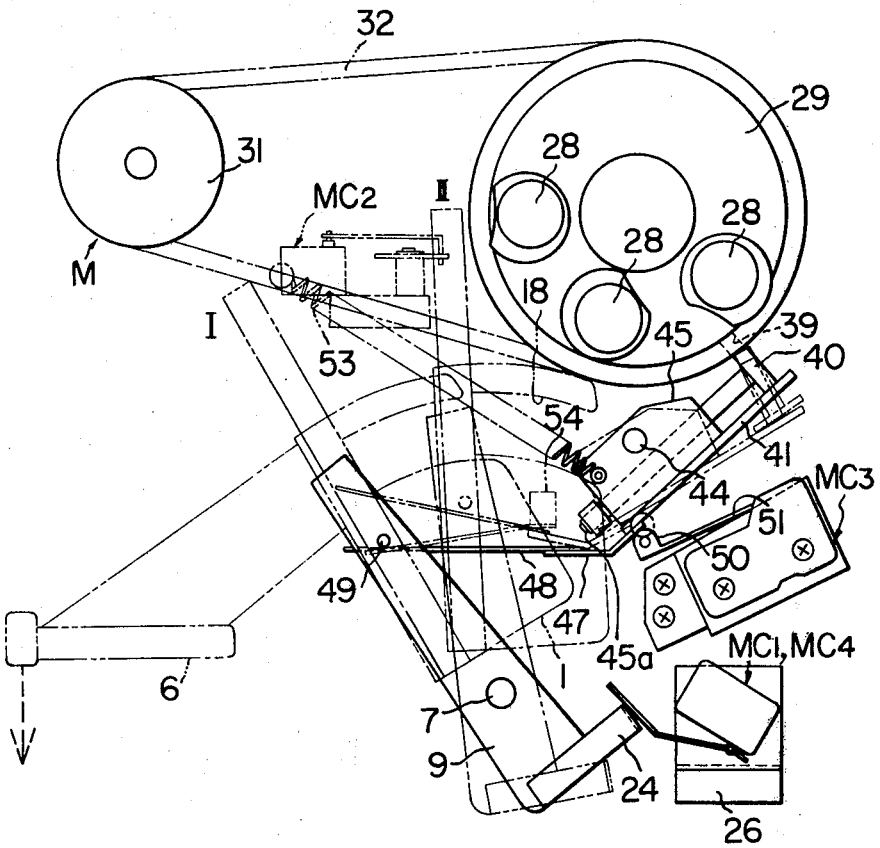
FIG. 2 is a schematic top plan view of the parts shown in FIG. 1.

At one end of the aforesaid planar arm 9 there is fixed a member 24 extending downwardly therefrom for pressing against an actuating member 25 of a switch $MC_1$ adapted for detection of the loading position I, FIG. 2, of the stack of sheets A and against an actuating member 25*a* of a switch $MC_4$ adapted for reversing the direction of rotation of a motor M. These switches $MC_1$ and $MC_4$ are fixedly mounted on a stationary support 26. An adjusting bolt is provided at 27 for regulating the motion of the planar arm 9.

The counting means 3 includes one or more, five in this particular embodiment of the invention, suction heads 28 for counting the number of the sheets A by separating the successive sheets from the rest of the stack in accordance with the prior art. As is well known, these suction heads 28 are each rotatably mounted on a disk 29 which is itself rotatable with another disk 30 therebelow. An endless belt 32 is wrapped around the periphery of the disk 30 and a pulley 31 securely mounted on the output shaft of the motor M, as best illustrated in FIG. 2, so that with the operation of the motor M the suction heads 28 are revolved on the disk 29 while rotating about their own axes. The suction heads 28 are communicated in a known manner with a vacuum pump, not shown in FIGS. 1 and 2, for separating the successive sheets A by suction exerted through their ports 33. A plurality of projections 34 are formed peripherally on the disk 30 for operating a counter switch $MC_5$ of a well known construction adapted for counting the number of the sheets separated as above stated, the projections 34 being equal in number to the suction heads 28.

A pin 35 extends downwardly from the elongate plate 11 to engage one end of the aforesaid spring member 10, and a helical tension spring 37 extends between this pin 35 and another pin or rod 36 fixedly supported by a stationary part of the machine.

The locking means 4 includes a click 40; one end of which is to be engaged with a groove 39 formed on the periphery of a mount 38 which is provided below the disk 30 for supporting the suction heads 28 and so forth. The other end of the click 40 is slidably received in a slot 42 formed in an elongate stop plate 41. A guide bolt 45*a* secured at one end thereof to a bracket 45 extends parallel to the stop plate 41 and is loosely inserted into and through a bore formed in the click 40. The bracket 45 is secured to the stop plate 41 and is turnably supported by a pin 44. The click 40 is resiliently urged to the right, as viewed in FIG. 1, by a helical compression spring 43 coiled around the guide bolt 45*a* and is prevented from detachment therefrom by a check nut 46.

A plate spring 48 is secured to the stop plate 41 through a member 47 and, as best shown in FIG. 2, is engaged by a pin 49 extending downwardly from the planar arm 9, thereby resiliently urging the click 40 counterclockwise, as seen in FIG. 2, through the stop plate 41. A member 50 secured at the forward end of a switch actuating member 51 is held in contact with the stop plate 41 in order to operate a switch $MC_3$ in accordance with the motion of the click 40, as hereinafter will be described in more detail. This switch $MC_3$ cooperates with the switch $MC_4$ to cause the motor M to rotate in the reversed direction and hence to place the suction heads 28 in the proper standby position hereinafter referred to.

The aforesaid bracket 45 is fixedly provided with a pin 52, FIG. 1, and a helical tension spring 53 extends between this pin 52 and another stationary pin, not shown, in order to normally maintain the click 40 out of engagement with the groove 39. An abutment is provided as indicated at 54 in FIG. 2 to restrict the clockwise motion of the plate spring 48.

Figure 3:
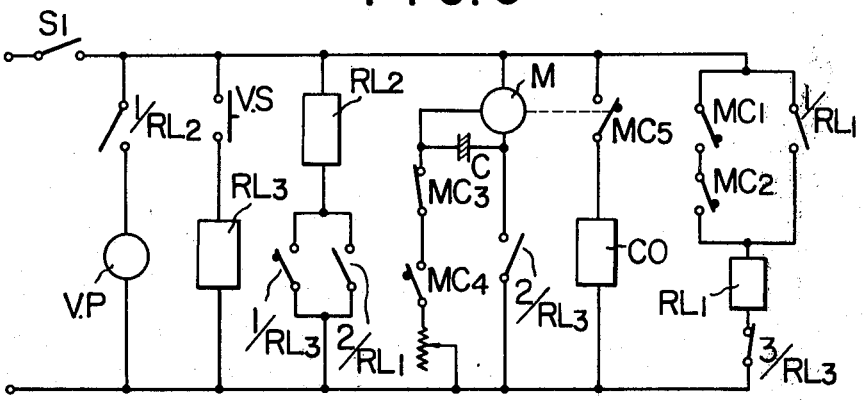
FIG. 3 is a schematic diagram of an electrical circuit for use with the exemplified sheet counter of FIGS. 1 and 2.

Proceeding now to the description of a mode of operation of the preferred embodiment of this invention, constructed as hereinbefore described, if now a power switch $S_1$ shown in FIG. 3 is closed and the L-shaped lever 6 is manually turned in the direction marked by the arrow in FIG. 2 for the loading of the stack of sheets A, until the planar arm 9 comes into contact with the adjusting bolt 15, the switch $MC_4$ becomes closed and the switch $MC_1$ becomes opened. On the other hand, when the suction heads 28 are not in their proper standby position shown in FIG. 2, that is, when the click 40 is held out of engagement with the grove 39 of the mount 38, the member 50 is pressed by the stop plate 40 to close the switch $MC_3$ through the actuating member 51. Consequently, the switches $MC_3$ and $MC_4$ are now both closed, the motor M is set in rotation in the reverse direction, as will be apparent from the circuit diagram of FIG. 3.

This reversed rotation of the motor M is conveyed by the endless belt 32 to the disk 30 to cause the suction heads 28 to be revolved clockwise as seen in FIGS. 1 and 2. As the click 40 becomes succeedingly received in the groove 39, the suction heads 28 are retained in their pre-determined standby positions. By this motion of the click 40, the switch $MC_3$ is opened by the members 50 and 51 thereby terminating the reversed rotation of the motor M.

Thereafter, the stack of sheets A is then placed in position on the support 5 in the loading position I shown by the dot-and-dash lines in FIG. 2. Upon completion of the sheet loading operation, the manual hold on the L-shaped lever 6 is released with the result that the stack of sheets A held on the support 5 is carried from the loading position I to the intermediate position II by means of the spring member 10. When the stack of sheets is transferred to the intermediate position II, the member 24 at one end of the planar arm 9 is thus caused to release the press against the actuating member 25; thereby closing the switch $MC_1$ so that the machine is now in a condition preparatory to counting operation. That is, upon closing of the switch $MC_2$, the counting circuit is surely established because the switch $MC_1$ is now in the closed state.

As the force of the spring member 10 becomes substantially exhausted with the stack of sheets A in this intermediate position II, the helical tension spring 37 becomes effective to pull the elongate plate 11 and hence to move the sheets A from the intermediate position II to the counting position. During this movement the lower edge of the sheets A presses against the actuating member 22 thereby closing the switch $MC_2$ through the lever 21.

Since the switches $MC_1$ and $MC_2$ are now both closed, the electric current from the power supply of the circuit of FIG. 3 flows through the power switch S1 and the switches $MC_1$ and $MC_2$ to a relay $RL_1$, thereby energizing the same. As a contact pair $1/RL_1$ thus becomes closed, the relay $RL_1$ is held operative, so that a contact pair $2/RL_1$ now becomes closed to energize a relay $RL_2$. As a result, a contact pair $1/RL_2$ becomes closed thereby setting the vacuum pump VP in operation. When the sheet is sucked by the stopped suction head and the vacuum pressure is increased to a predetermined value by said operation of the vacuum pump, a valve switch VS becomes thereby closed to energize a relay $RL_3$. By this energization of the relay $RL_3$, a contact pair $2/RL_3$ is closed, thereby initiating the rotation of the motor M in its forward direction. However, although a normally closed contact pair $3/RL_3$ is opened with the energization of the relay $RL_3$, the contact pair $1/RL_3$ is held closed, so that the relay $RL_2$ is held energized. The vacuum pump VP thus remains in operation.

By the operation of this vacuum pump, a partial vacuum is created within the suction heads 28 shown in FIGS. 1 and 2, so that atmospheric air is drawn therein through the ports 33. During counting operation these suction heads are caused to rotate clockwise, as viewed in FIGS. 1 and 2, about their own axes while revolving counterclockwise around the axis of the disk 29. The foremost one of the sheets A held in a stack upon the support 5 is thus successively caused to flex upon the cylindrical member 16 wrapped around the post 17 and further to separate from the rest of the stack. The number of the sheets being thus separated is counted as the counter switch $MC_5$ is successively operated by the projections 34 formed on the periphery of the disk 30.

Upon completion of counting of all sheets A placed initially upon the support 5, there are no more sheets to be sucked up by the suction head, so that the vacuum pressure decreases, and upon decrease of said pressure to below a pre-determined value the vacuum switch VS is opened, whereby the relay $RL_3$ is de-energized and thereby opening the contact pair $2/RL_3$ and stopping the motor M. On the other hand, the relay contact pair $3/RL_3$ having been opened during the counting operation is closed, but the relay contact pair $1/RL_1$ is in the opened state and the switch $MC_2$ is also in the opened state because of the release thereof from the pushing by the sheet, so that the relay $RL_1$ is retained in its de-energized state. Accordingly, if the relay contact pair $1/RL_2$ is opened, the relay $RL_2$ is also de-energized because of the open state of the contact pair $2/RL_1$ due to the de-energization of the relay $RL_1$, whereby the contact pair $1/RL_2$ is opened and the vacuum pump (V.P.) stops. Both the motor M and the vacuum pump VP are thus rendered inoperative until a new stack of sheets is loaded again after the L-shaped lever 6 has been manually moved in the arrow-marked direction as above stated.

Although the present invention has been shown and described hereinbefore in terms of a specific embodiment thereof, it is understood that the invention itself is not to be restricted by the exact showing of the drawings and the description thereof but is considered to include a latitude of modifications, substitutions and changes.

I claim:

1. An automatic sheet counting apparatus, which comprises:

sheet holding means comprising a support member for holding a stack of sheets, a holding member for securing said stack of sheets against said support member, and a first lever member to which said holding member is pivotally connected about a first pivot at one end thereof, said first lever member being itself pivotable about said first pivot from a sheet stack loading position through an intermediate position to a sheet stack counting position;

sheet counting means including at least one suction head means for separating a sheet from said sheet stack when the latter is in said sheet stack counting position;

first spring means for rotating said first lever member and said support member from said sheet stack loading position to said intermediate position;

second spring means for rotating said support member from said intermediate position to said sheet stack counting position adjacent said suction head;

drive means for rotating said sheet counting means in a forward or reverse direction;

vacuum pump means for creating a predetermined vacuum required for said suction head means in order to successively separate sheets held by said support means;

means for adjusting the position of said suction head relative to said sheet stack prior to the activation of said vacuum pump means, said adjusting means including a second lever member pivotable about a second pivot near one end thereof, a click member located at the distal end of said second lever member for locking engagement with a slot in said sheet counting means when said suction head is properly positioned relative to said sheet stack, said second lever member being pivotable about said second pivot by said first lever member when the latter is moved from said intermediate position to said sheet stack loading position, and third spring means for biasing said second lever member out of said locking engagement when said first lever member is in said sheet stack counting position; and electrical circuit means for automatically controlling the operation of said position adjusting means, said vacuum pump means, said drive means, and said sheet counting means, said electrical circuit means comprising a first normally closed switch which is opened by said first lever member only when in said sheet loading position, a second normally open switch which is closed by said first lever member only when in said sheet loading position, a third normally open switch which is closed by said second lever member only when the latter is out of said locking engagement, a fourth normally open switch which is closed by said first lever member while moving between said intermediate position and said sheet counting position, a fifth normally open switch which is closed periodically by the forward rotation of said sheet counting means, and a sixth normally open vacuum valve switch which is closed upon the establishment of said predetermined vacuum; the closure of said second and third switches causing said drive means to rotate in said reverse direction, the closure of said first and fourth switches activating said vacuum pump means, the closure of said sixth switch causing said drive means to rotate in said forward direction, the closure of said fifth switch activating a counter for recording the number of sheets successively separated from said stack, the subsequent opening of said fourth and sixth switches causing said drive means and said vacuum pump means to cease operating.

2. The automatic sheet counting apparatus as set forth in claim 1, wherein said first and fourth switches are series connected to one another, the series connection thereof being connected in parallel with the series connection of said second and third switches, which are in turn connected in parallel with said fifth switch, which is in turn connected in parallel with said sixth switch.

3. The automatic sheet counting apparatus as set forth in claim 2, wherein said second and third switches are connected in series with the reverse terminals of said drive means, and wherein said drive means is connected in parallel with said sixth switch means and with said vacuum pump means, the latter being parallel connected to the series connection of said first and fourth switch means.

4. An automatic sheet counting apparatus, which comprises:

sheet holding means comprising a support member for holding a stack of sheets, a holding member for securing said stack of sheets against said support member, and a first lever member to which said holding member is pivotally connected about a first pivot at one end thereof, said first lever member being itself pivotable about said first pivot from a sheet stack loading position through an intermediate position to a sheet stack counting position;

sheet counting means including at least one suction head means for separating a sheet from said sheet stack when the latter is in said sheet stack counting position;

first spring means for rotating said first lever member and said support member from said sheet stack loading position to said intermediate position;

second spring means for rotating said support member from said intermediate position to said sheet stack counting position adjacent said suction head;

drive means for rotating said sheet counting means in a forward or reverse direction;

vacuum pump means for creating a predetermined vacuum required for said suction head means in order to successively separate sheets held by said support means;

means for adjusting the position of said suction head relative to said sheet stack prior to the activation of said vacuum pump means, said adjusting means including a second lever member pivotable about a second pivot near one end thereof, a click member located at the distal end of said second lever member for locking engagement with a slot in said sheet counting means when said suction head is properly positioned relative to said sheet stack, said second lever member being pivotable about said second pivot by said first lever member when the latter is moved from said intermediate position to said sheet stack loading position, and third spring means for biasing said second lever member out of said locking engagement when said first lever member is in said sheet stack counting position;

electrical circuit means for automatically controlling the operation of said position adjusting means, said vacuum pump means, said drive means, and said sheet counting means, said electrical circuit means comprising a first normally closed switch which is opened by said first lever member only when in said sheet loading position, a second normally open switch which is closed by said first lever member only when in said sheet loading position, a third normally open switch which is closed by said second lever member only when the latter is out of said locking engagement, a fourth normally open switch which is closed by said first lever member while moving between said intermediate position and said sheet counting position, a fifth normally open switch which is closed periodically by the forward rotation of said sheet counting means, and a sixth normally open vacuum valve switch which is closed upon the establishment of said predetermined vacuum; the closure of said second and third switches causing said drive means to rotate in said reverse direction, the closure of said first and fourth switches activating said vacuum pump means, the closure of said sixth switch causing said drive means to rotate in said forward direction, the closure of said fifth switch activating a counter for recording the number of sheets successively separated from said stack, the subsequent opening of said fourth and sixth switches causing said drive means and said vacuum pump means to cease operating; and wherein said electrical circuit means further comprises first, second and third relays, said first relay being connected in series with said first and fourth switches and having first and second normally open contact pairs responsive thereto, said second relay being connected in parallel with said vacuum pump means and having one normally open contact pair responsive thereto, said third relay being connected in series with said sixth switch and having first and second normally open contact pairs and a third normally closed contact pair being responsive thereto.

5. An automatic sheet counting apparatus, which comprises:

sheet holding means comprising a support member for holding a stack of sheets, a holding member for securing said stack of sheets against said support member, and a first lever member to which said holding member is pivotally connected about a first pivot at one end thereof, said first lever member being itself pivotable about said first pivot from a sheet stack loading position through an intermediate position to a sheet stack counting position;

sheet counting means including at least one suction head means for separating a sheet from said sheet stack when the latter is in said sheet stack counting position;

first spring means for rotating said first lever member and said support member from said sheet stack loading position to said intermediate position;

econd spring means for rotating said support member from said intermediate position to said sheet stack counting position adjacent said suction head;

rive means for rotating said sheet counting means in a forward or reverse direction;

acuum pump means for creating a predetermined vacuum required for said suction head means in order to successively separate sheets held by said support means;

ıeans for adjusting the position of said suction head relative to said sheet stack prior to the activation of said vacuum pump means, said adjusting means including a second lever member pivotable about a second pivot near one end thereof, a click member located at the distal end of said second lever member for locking engagement with a slot in said sheet counting means when said suction head is properly positioned relative to said sheet stack, said second lever member being pivotable about said second pivot by said first lever member when the latter is moved from said intermediate position to said sheet stack loading position, and third spring means for biasing said second lever member out of said locking engagement when said first lever member is in said sheet stack counting position;

lectrical circuit means for automatically controlling the operation of said position adjusting means, said vacuum pump means, said drive means, and said sheet counting means, said electrical circuit means comprising a first normally closed switch which is opened by said first lever member only when in said sheet loading position, a second normally open switch which is closed by said first lever member only when in said sheet loading position, a third normally open switch which is closed by said second lever member only when the latter it out of said locking engagement, a fourth normally open switch which is closed by said first lever member while moving between said intermediate position and said sheet counting position, a fifth normally open switch which is closed periodically by the forward rotation of said sheet counting means, and a sixth normally open vacuum valve switch which is closed upon the establishment of said predetermined vacuum; the closure of said second and third switches causing said drive means to rotate in said reverse direction, the closure of said first and fourth switches activating said vacuum pump means, the closure of said sixth switch causing said drive means to rotate in said forward direction, the closure of said fifth switch activating a counter for recording the number of sheets successively separated from said stack, the subsequent opening of said fourth and sixth switches causing said drive means and said vacuum pump means to cease operating;

wherein said electrical circuit means further comprises first, second and third relays, said first relay being connected in series with said first and fourth switches and having first and second normally open contact pairs responsive thereto, said second relay being connected in parallel with said vacuum pump means and having one normally open contact pair responsive thereto, said third relay being connected in series with said sixth switch and having first and second normally open contact pairs and a third normally closed contact pair being responsive thereto;

wherein said first contact pair of said first relay is connected in parallel with said first and fourth switches;

said second contact pair of said first relay is connected in series with said second relay and in parallel with said first contact pair of said third relay;

said one contact pair of said second relay is connected in series with said vacuum pump means;

said second contact pair of said third relay is connected in parallel with said second and third switches and in series with the forward terminals of said drive means;

said third contact pair of said third relay is connected in series with said first relay; and wherein said first and fourth switches are series connected to one another, the series connection thereof being connected in parallel with the series connection of said second and third switches, which are in turn connected in parallel with said fifth switch, which is in turn connected in parallel with said sixth switch; and wherein said second and third switches are connected in series with the reverse terminals of said drive means, and wherein said drive means is connected in parallel with said sixth switch means and with said vacuum pump means, the latter being parallel connected to the series connection of said first and fourth switch means.

* * * * *